United States Patent [19]

Herring, Jr. et al.

[11] 4,196,671

[45] Apr. 8, 1980

[54] RAILWAY CAR LOW FRICTION SIDE BEARINGS

[75] Inventors: James M. Herring, Jr., Merion Station; George Mekosh, Jr., Warrington, both of Pa.

[73] Assignee: The Budd Company, Troy, Mich.

[21] Appl. No.: 867,668

[22] Filed: Jan. 9, 1978

[51] Int. Cl.[2] ..... B61F 3/04; B61F 5/06; B61F 5/10; B61F 5/14

[52] U.S. Cl. ..... 105/199 R; 105/197 B; 105/199 CB; 267/3; 308/138

[58] Field of Search ..... 105/108, 133, 171, 182 R, 105/197 B, 199 R, 200, 199 CB; 267/3; 308/138

[56] References Cited

U.S. PATENT DOCUMENTS

| | | | |
|---|---|---|---|
| 538,865 | 5/1865 | Brill, et al. | 105/171 |
| 2,908,230 | 10/1959 | Dean | 105/197 B X |
| 3,020,857 | 2/1962 | Dean | 105/199 R |
| 3,343,830 | 9/1967 | Dean et al. | 267/3 X V |
| 3,961,584 | 6/1976 | Paton et al. | 308/138 X |

*Primary Examiner*—Joseph F. Peters, Jr.
*Assistant Examiner*—Howard Beltran
*Attorney, Agent, or Firm*—A. L. Trueax, Jr.

[57] ABSTRACT

A bolster for carrying a car body rests transversely on a pair of side frames of a truck. A side bearer and wear plate assembly are disposed between the ends of the bolster and the side frames to permit the bolster to be rotated relatively about small angles with respect to the side frames. The side bearers each comprise a body having relatively low friction surfaces in engagement with the wear plates. Each of the low friction surfaces may include two or more parallel arcuate tracks or segments which may have radii corresponding to the directions of angular rotation movements of the bolster. The total surface area of the low friction surfaces is designed for optimum operation for predetermined load conditions.

6 Claims, 5 Drawing Figures

FIG. 3
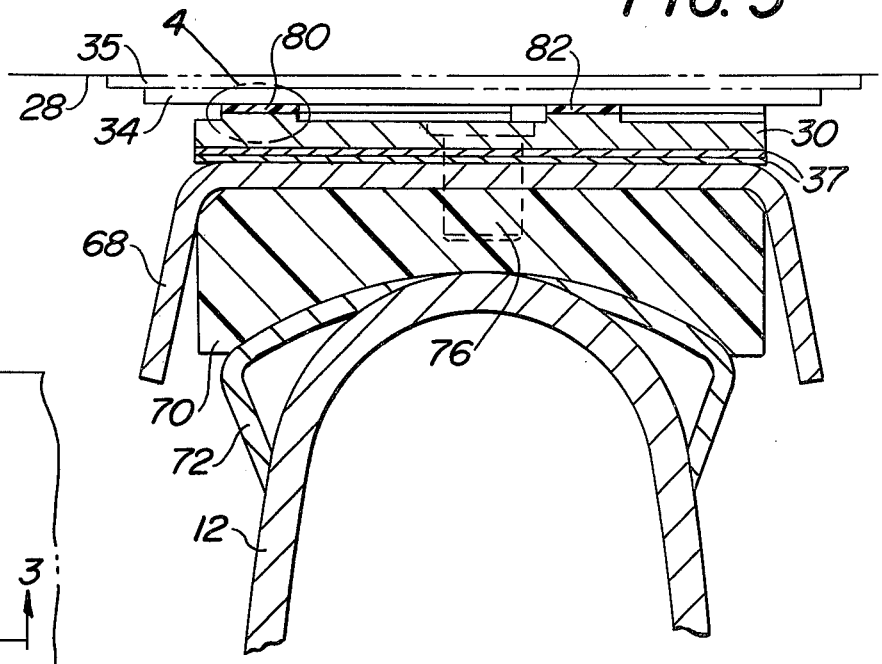
FIG. 2
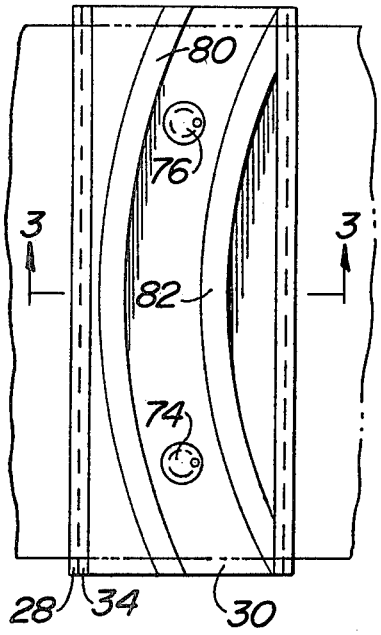
FIG. 4
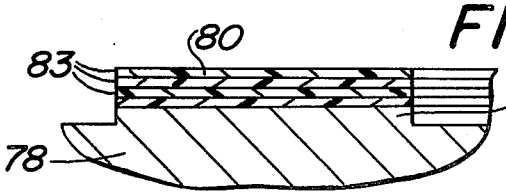
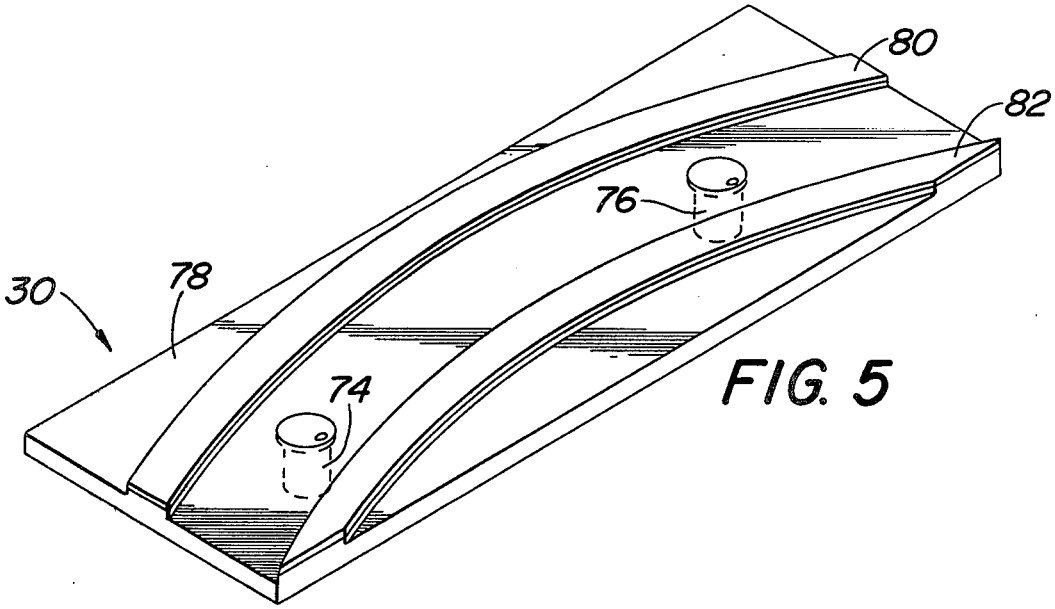
FIG. 5

RAILWAY CAR LOW FRICTION SIDE BEARINGS

It is known in railway cars that the car body is generally carried by at least a pair of trucks. In many arrangements, a bolster for carrying the car body rests on a pair of side frames which are included in each of the trucks. Various suspension means, such as mechanical and/or air springs, may be disposed between the bolster and the car body. Vertical and horizontal shock absorbers are employed between the car body and bolsters. Stay or hold rods are also connected between the bolster and the car body.

Side bearer and wear plate assemblies have been, in the past, been disposed between the bolster and the side frames to permit relatively small angular movements of the car body carrying the bolster with respect to the side frames. Such arrangements are illustrated in patents to A. G. Dean U.S. Pat. No. 3,020,857 and to A. G. Dean et al. U.S. Pat. No. 3,343,830. In these patents, the side bearers and their associated wear plates are relatively wide and rest on shoe elements. Flexible pads are disposed between the shoe elements and the side frames.

When standard size side bearers are used with different loads, it is difficult to obtain maximum satisfactory operating conditions in the railcar. For example, different loads result in different coefficients of friction between the side bearers and wear plates. For a particular load, a predetermined coefficient of friction relationship between the side bearer and wear plate is desirable to optimize operation conditions. In addition to the coefficient of friction, various wear factors and loading paths between the car body and truck must be considered in order to maximize the design of the overall car.

The aforementioned type of side bearer-wear plate assemblies, while satisfactory in many cases, has presented a number of disadvantages. First, the contact resistances or coefficients of friction between the side bearers and wear plates are generally to high. Lowering these coefficients of friction without considering other factors, introduce other problems. For example, the loading conditions must also be considered so that reducing the frictional areas involved in the side bearers do not result in bearers which are too small to support the loads involved or to transfer stress from the car body to the truck.

A second problem encountered in past systems involved the stresses produced by the loadings on the shoes carrying the slide bearing-wear plate assemblies. If the side bearers are made narrower to obtain the proper frictional resistances, the shoes will tend to break down, especially towards the center areas along the longitudinal directions of the side frames where excess loadings are applied.

It is an object of this invention to provide an improved frictional element between the bodies movable with respect to each other, in which the total surface areas are designed with frictional coefficients for optimum operation for predetermined loading of one of the bodies on the other.

It is a further object of this invention to provide an improved side bearer arrangement for accommodating relatively small turning movements of a bolster on side frames of a truck, such as may occur during turns.

It is a further object of this invention to provide an improved side bearer for accommodating relatively small turning movements of a bolster on side frames of a truck with the friction therebetween maximized with respect to a particular load.

It is a further object of this invention to provide an improved side bearer on a bolster in which loading on the side frames is distributed to minimize possible damage to coupling members between the bearings and side frames.

In accordance with the present invention, a railway car body is carried by a bolster which rests transversely on a pair of side frames of a truck. A side bearer and wear plate assembly is secured towards each end of the bolster, with the side bearers disposed to slidably engage the wear plates. This permits the bolster to be rotated relatively small angles about its center with respect to the side frames. Each of the side bearers comprise an integral body having low friction surfaces including at least two spaced parallel arcuate tracks or segments having radii corresponding to the directions of rotation movements of the bolster. The coefficient of friction is determined with due regard to the low friction material involved, the total surface area of the friction material and the loading or stresses involved.

Other objects and advantages of the present invention will be apparent and suggest themselves to those skilled in the art from a reading of the following specifications and claims, in conjunction with the accompanying drawings, in which:

FIG. 2 is a top view of one of the side bearer-wear plate assemblies, illustrated in FIG. 1, in accordance with the present invention;

FIG. 3 is a side view taken along lines 3—3 of FIG. 2;

FIG. 4 is an enlarged view of a section 4 encircled in FIG. 3, illustrating a side bearer in accordance with the present invention; and FIG. 5 is an isometric view of the side bearing illustrated in FIG. 2 without its associated components.

Figure 1:
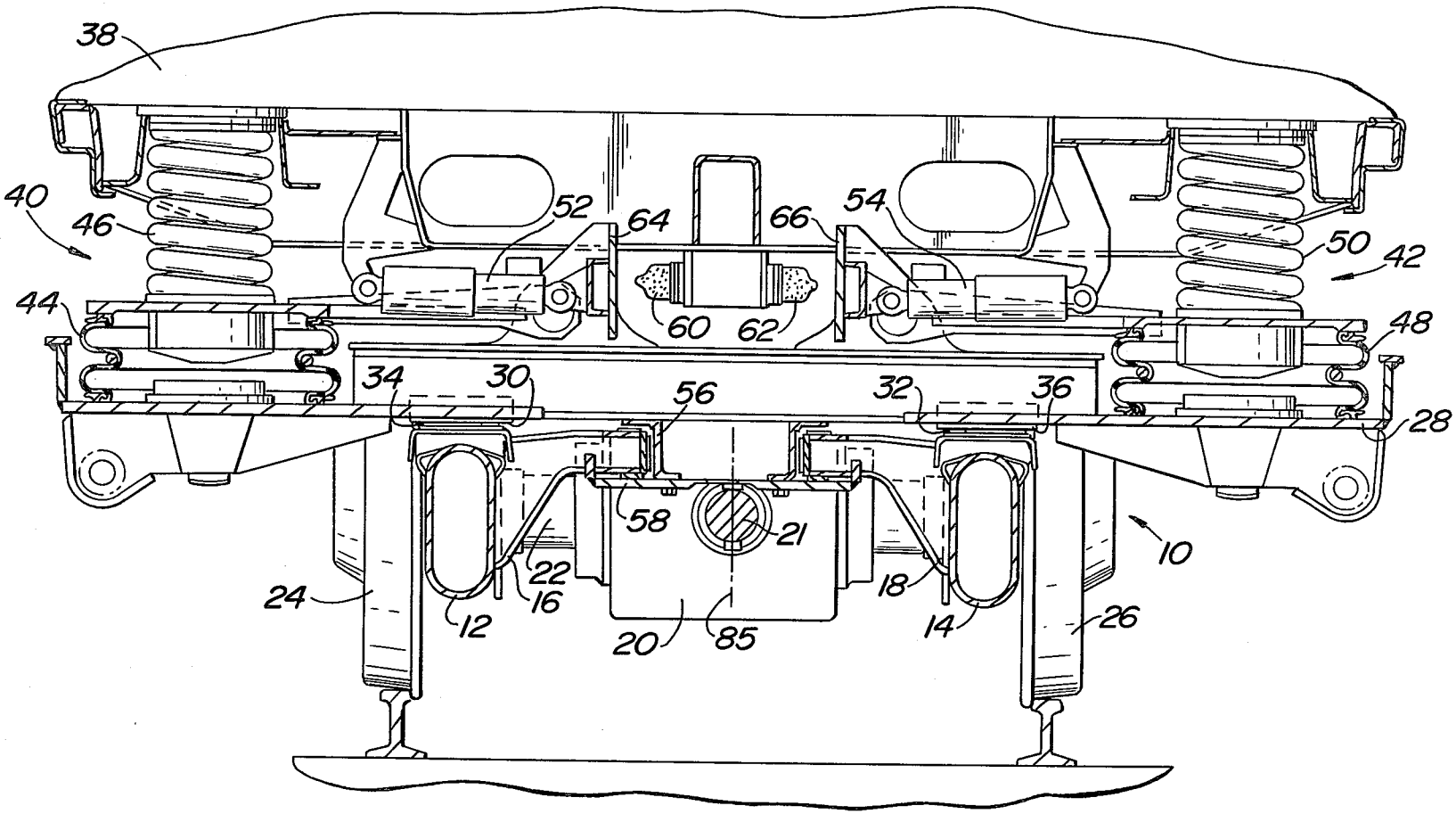
FIG. 1 is a cross-section of a truck for carrying a railway car body embodying side bearers, in accordance with the present invention.

In order to illustrate one working embodiment of the present invention, the main portions of one of the trucks for carrying a car body, of the type in which the present invention may be used, is illustrated in FIG. 1.

Referring to FIG. 1, a truck 10 comprises a pair of side frames 12 and 14 having a spider-like structure extending therefrom including four arms of which only two arms 16 and 18 are illustrated. A truck arrangement including a spider-like structure which has some of the features of the truck illustrated is described in a patent to W. G. Dean, U.S. Pat. No. 2,908,230, issued Oct. 13, 1959.

Gear boxes are mounted to a pair of axles, with only one gear box 20 driving axle 22 being illustrated. Mechanism associated with the gear box 20 may be connected to drive the other axle of the truck (not illustrated) through a shaft 21. Wheels 24 and 26 are suitably mounted to the axle 22.

A bolster 28 is supported transversely on the side frames 12 and 14. Side bearers 30 and 32 are disposed on the side frames 12 and 14, respectively, and wear plates 34 and 36 are disposed on the bottom of the bolster 28. The side bearers 30 and 32 slidably engage the wear plates 34 and 36 and permit the bolster 28 to be turnable or slideable with respect to the truck side frames 12 and 14 about relatively small angles, as when the railway car is going around turns, for example.

A car body 38 has its bottom structure supported on the bolster 28 by means of a pair of spring suspensions 40 and 42. The spring suspension 40 comprises an air spring 44 and a mechanical spring 46 serially connected to each other. The spring suspension 42 comprises an air spring 48 and a mechanical spring 50 also serially connected. Lateral shock absorbers 52 and 54 are connected through any suitable connecting elements between the car body 38 and the bolster 28. Pairs of vertical shock absorbers and stay bars normally used in typical systems are not illustrated.

The bottom of the bolster 28 includes a center pin 56 mounted thereto which is adapted to fit into a generally circular opening provided at the ends of four arms, of which only arms 16 and 18 are illustrated. The center pin 56 is held in place by means of a plate member 58 bolted thereto.

A pair of lateral bumpers 60 and 62 are mounted to the car body 38 to permit the lateral movement thereof. Stop members 64 and 66 are connected to the bolster 28 to limit lateral movements of the car body 38 when they are contacted by either of the bumpers 60 or 62.

Referring particularly to FIGS. 2 and 3, one of the side bearer-wear plate arrangements is illustrated between the bolster 28 and the side frame 12. The wear plate 34 is secured to the bolster 28. A shim member 35 is sometimes necessary. This plate may be made of steel, aluminum or other long wearing material, which may include different compositions and sometimes coatings.

The side bearer 30 is secured to a shoe member 68. Shim members 37 may sometimes be used. A shock pad 70, which may be a flexible material, is disposed to support the shoe member 68. The shock pad 70 rests on a saddle-like member 72 which extends beyond the top portion of the side frame 12. The side bearer 30 is fixedly connected by a press fit through openings in the shoe member 68 by means of dowels 74 and 76.

Referring to FIGS. 4 and 5, the side bearer 30 comprises an integral piece including a main body 78 which include the suitably connected dowels 74 and 76 disposed to be press fitted through openings in the shoe member (FIGS. 2 and 3). A pair of raised arcuate tracks 80 and 82 are included towards the top of the main body 78 and comprise low friction surfaces to engage the wear plates 34 and 36 (FIGS. 1, 2, 3).

The side bearer 30 may comprise phenolic resin impregnated cotton fabric 81 on which layers of Teflon fabric 83 are imposed. The body may be formed in a suitable mold with the tracks machined in the main body after the molding operation. In some cases, the tracks may be formed by the mold, eliminating the need for machining.

The radii of the tracks 80 and 82 are about the center 85 of the bolster 28 (FIG. 1). When the bolster 28, with the car body 38, is moved about relatively small angles with respect to the truck 10, the wear plates 34 and 36 ride upon the side bearers 30 and 32, respectively. As mentioned, these movements may occur when the railway car is going around turns.

Heretofore, the side bearers employed in engaging the wear plates comprised a single relatively wide surface and consequently wide areas of contacts. Generally with such design, it was difficult to optimize the frictional relationship with respect to the loads of the car body. The double track arrangement illustrated minimizes the areas of contacts between the slide bearings and the wear plates to minimize the friction thereby permitting the bolster to move more readily about the desired angles during operation.

In addition to minimizing the friction involved, the double track arrangement provides that the pressures exerted on the shoe element 68 are towards the edges thereof and away from its center which is disposed along the longitudinal axis of the side frame 12. This minimizes the likelihood of the shoe element 68 being damaged as a result of splitting towards its longitudinal center because of excessive pressure exerted thereon.

It is noted that the use of Teflon instead of other low friction surfaces offer special advantages. When lower or lighter loads are employed, the friction coefficient goes up. When higher or heavier loads are employed, the friction coefficient goes down. Thus with very heavy leads; the use of Teflon as the contact surface of the side bearers on the wear plates provides the low friction required for steering the railway car. The use of the double Teflon surfaced tracks provide means for taking the load concentrations from the car body and spreading them through the main bodies of the side bearers, which comprises resin impregnated cotton fabric.

It is known that Teflon has the unique property that the friction coefficient reduces as the unit loading goes up. For the type of material used in the embodiment described, the following illustrates some of its characteristics. At a unit loading 200 psi, the friction coefficient is approximately 0.17; at 1000 psi, it is reduced to approximately 0.09; and at 2000 psi it is further reduced to approximately 0.07. At a unit loading of 3000 psi, the friction coefficient goes down below 0.02 and at 4000 psi it goes down to 0.105, and at 5000 psi it is down to approximately 0.01. The side bearers described may be readily designed for different unit loadings and are especially adapted for low friction applications. In the invention described, the particular unit loadings are related to car weights, empty and full, and a number of other design features associated with the parts and spacings used in a particular car.

With respect to the side bearers described, a high unit loading is possible with the desired low friction characteristic. Each layer of Teflon fabric is approximately 0.015 in thickness. The cotton cloth may be impregnated with graphite. The material described in connection with the side bearers or bearer members may be of the type manufactured by Gatke Corporation of Warsaw, Indiana.

A double continuous track arrangement has been illustrated as a preferred embodiment. This arrangement provides sufficient stress distribution with enough width to support the relatively heavy loadings involved. The arrangement provides a self cleaning arrangement during operation. Basically, however, the total area of the two tracks are related to a particular loading with this total area being changeable to accommodate different loading, i.e., shorter and wider tracks with the same total surface area may be used.

Conceivably, the tracks could be divided into segments with the tracks being made wider to achieve the same surface area for a particular design. While dirt may tend to accumulate between the segments, its non-self cleaning disadvantage may be acceptable in some cases or taken care of by additional means.

Laterally disposed tracks or randomly disposed segments may be designed to achieve the same total surface areas as the double track arrangement, but would not offer the self-cleaning advantage and may tend to accumulate dirt particles therebetween during operation.

It is noted that with the double track arrangements, the stresses are distributed thereby spreading out the stresses on the shoe members, such as the shoe member 68 illustrated in FIG. 3. This minimizes the likelihood of these shoe members splitting as a result of excessive loadings towards their centers.

What is claimed is:

1. In a railway car carried by a carrier body, the combination comprising:

(a) a bearer member disposed between said car body and said carrier body to permit said car body and carrier body to be rotated about relatively small angles with respect to each other, (b) said bearer member being fixedly connected to one of said bodies for engaging a wear surface on the other of said bodies, said bearer member having at least two spaced low friction surfaces, and, (c) said low friction surfaces being parallel and in substantially the same plane.

2. The invention as set forth in claim 1 wherein said at least two spaced friction surfaces coomprise arcuately shaped tracks corresponding to the relative rotational movement of said car body and said truck.

3. The invention as set forth in claim 2 wherein said carrier body comprises a truck with a pair of side frames and a bolster connected to said car body, said bolster resting on a pair of shoe members supported on said side frame with a pair of said bearer members disposed between said shoe members and said bolster.

4. The invention as set forth in claim 3 wherein a pair of wear plates are fixedly connected to said bolster to engage the low friction surfaces of said bearer members.

5. The invention as set forth in claim 4 wherein said bearer members comprise integral bodies of impregnated cotton fabric with surfaces of low friction fabric material.

6. The invention as set forth in claim 5 wherein said low friction fabric material has a characteristic with lower coefficients of friction for higher loads.

* * * * *